US007758039B2

(12) United States Patent
Lee

(10) Patent No.: US 7,758,039 B2
(45) Date of Patent: Jul. 20, 2010

(54) IMAGE FORMING APPARATUS

(75) Inventor: Jin Soo Lee, Suwon-si (KR)

(73) Assignee: Samsung Electronics Co., Ltd., Suwon_Si (KR)

( * ) Notice: Subject to any disclaimer, the term of this patent is extended or adjusted under 35 U.S.C. 154(b) by 0 days.

(21) Appl. No.: 12/125,719

(22) Filed: May 22, 2008

(65) Prior Publication Data

US 2009/0008866 A1 Jan. 8, 2009

(30) Foreign Application Priority Data

Jul. 4, 2007 (KR) ..... 10-2007-0067044

(51) Int. Cl.
*B65H 3/06* (2006.01)

(52) U.S. Cl. ..... 271/119; 492/30; 492/38

(58) Field of Classification Search ..... 271/119; 492/30, 36, 38

See application file for complete search history.

(56) References Cited

U.S. PATENT DOCUMENTS 1,291,074 A * 1/1919 Milmoe et al. ..... 271/119
1,626,386 A * 4/1927 Bronander ..... 271/119
1,919,238 A * 7/1933 McCarthy ..... 271/119
4,394,009 A * 7/1983 Bergman et al. ..... 271/10.12
4,437,656 A * 3/1984 Onoda et al. ..... 271/10.12
4,443,006 A * 4/1984 Hasegawa ..... 271/10.11
4,958,825 A * 9/1990 Onomoto et al. ..... 271/119
6,000,690 A * 12/1999 Kudoh ..... 271/117

FOREIGN PATENT DOCUMENTS

KR 10-2005-0110224 11/2005

OTHER PUBLICATIONS

English language abstract of KR 10-2005-0110224, published Nov. 23, 2005.

* cited by examiner

*Primary Examiner*—David H Bollinger
(74) *Attorney, Agent, or Firm*—DLA Piper LLP US

(57) ABSTRACT

Disclosed is an image forming apparatus equipped with a pick-up roller to pick up a sheet. The image forming apparatus includes a sheet feeding tray, in which sheets are stacked, and a pick-up roller to pick up sheet from the sheet feeding tray. The pick-up roller includes a pick- up section to pick up the sheet and a feed section to deliver a sheet feeding pressure greater than that of the pick-up section to the sheet, so that a component corresponding to a feed roller can be removed, thereby simplifying the structure of the image forming apparatus and lowering the height of the image forming apparatus.

14 Claims, 4 Drawing Sheets

IMAGE FORMING APPARATUS

CROSS-REFERENCE TO RELATED APPLICATIONS

This application claims the benefit of Korean Patent Application No. 10-2007-0067044, filed on Jul. 4, 2007, in the Korean Intellectual Property Office, the disclosure of which is incorporated herein by reference.

BACKGROUND OF THE INVENTION

1. Field of the Invention

The present invention relates to an image forming apparatus. More particularly, the present invention relates to an image forming apparatus equipped with a pick-up roller to pick up a sheet.

2. Description of the Prior Art

Generally, an image forming apparatus prints an image on print media (e.g., a sheet) by using an input image signal. Such an image forming apparatus irradiates a laser beam onto a photo-conductive drum charged with predetermined potential to form an electrostatic latent image on the outer peripheral surface thereof, applies a developer to the electrostatic latent image to make a visible image, transfers and fixes the visible image onto a sheet, thus printing the visible image on the sheet.

As disclosed in Korean Unexamined Publication No. 10-2005-110224, conventional image forming apparatuses include a body forming an outer appearance of the image forming apparatus, a sheet feeding unit to supply a sheet which is a printing medium, an image forming unit to form an image on the sheet, a fixing unit to fix the image onto the sheet by applying heat and pressure onto the sheet, and a sheet discharging unit to discharge the sheet having undergone the printing operation to the outside of the body.

In the above image forming apparatuses, there is an image forming apparatus including a sheet feeding unit equipped with a sheet feeding tray having sheets stacked thereon, a pick-up roller to pick up one of the sheets stacked on the sheet feeding tray, a pair of regi-rollers to arrange the sheets, and a regi-shutter, which is rotatably mounted on one of the regi-rollers, and which rotates only when a sheet feeding pressure exceeding a predetermined value is applied to allow the sheet to enter the space between the two regi-rollers.

Since the pick-up roller may simultaneously pick up a plurality of sheets when the sheet feeding pressure exceeds the predetermined value, the sheet feeding pressure must be limited to below certain level. However, the regi-shutter rotates only when the sheet feeding pressure exceeding the predetermined value is exerted on a sheet to enable the sheet to pass through the space between the regi-rollers.

The conventional image forming apparatus further requires a feed roller between the pick-up roller and the regi-roller to generate a sheet feeding pressure exceeding a predetermined value, and to deliver the sheet feeding pressure to the sheet, such that the sheet can enter the space between the regi-rollers while rotating the regi-shutter.

As described above, in the conventional image forming apparatus, since the feed roller must be installed between the pick-up roller and the regi-roller, not only the structure of the conventional image forming apparatus may become complicated, but also the height thereof may be increased in order to ensure the installation space of the feed roller.

SUMMARY OF THE INVENTION

Accordingly, it is an aspect of the present invention to provide an image forming apparatus having a simpler structure by providing a pick up roller that can impart both the pick-up pressure sufficient to pick-up a sheet of print medium and the feed pressure sufficient to deliver the picked up sheet further in the sheet travel path in the image forming apparatus.

Additional aspects and/or advantages of the invention will be set forth in part in the description which follows and, in part, will be apparent from the description, or may be learned by practice of the invention.

The foregoing and/or other aspects of the present invention are achieved by providing an image forming apparatus comprising a sheet feeding tray, in which sheets of printing medium are stacked, and a pick-up roller to pick up a sheet from the sheet feeding tray, wherein the pick-up roller comprises a pick-up section to pick up the sheet and a feed section to deliver to the sheet a sheet feeding pressure greater than the pick-up pressure of the pick-up section.

According to an aspect of the present invention, the pick-up roller has a sector shape, the pick-up section is provided at a front portion of the pick-up roller along the rotational direction of the pick-up roller, and the feed section is provided at a rear portion of the pick-up roller in the rotational direction of the pick-up roller.

According to an aspect of the present invention, the feed section is defined by a feed unit protruding from an outer peripheral surface of the pick-up roller such that the feed section has a radius greater than the radius of the pick-up section.

According to an aspect of the present invention, the pick-up roller comprises a frame member, which comprises a hinge hole to receive a rotary power, and a friction member, which covers an outer surface of the frame member to make contact with a sheet, and wherein the feed unit protrudes from an outer peripheral surface of the friction member.

According to an aspect of the present invention, the pick-up roller comprises a frame member, which comprises a hinge hole to receive a rotary power, and a friction member, which covers an outer surface of the frame member to make contact with the sheet, and wherein the frame member comprises a slot formed on the outer surface of the frame member at the location corresponding to the pick-up section.

According to an aspect of the present invention, the image forming apparatus further comprises a pair of regi-rollers which receive the sheet conveyed by the pick-up roller, and a regi-shutter which is rotatably mounted on at least one of the pair of regi-rollers to oppose the sheet and to rotate to enable the sheet to advance to the pair of regi-rollers when a sheet feeding pressure exceeding a predetermined value is transferred through the sheet.

It is another aspect of the present invention to provide an image forming apparatus comprising a sheet feeding tray, in which sheets are stacked, a pick-up roller to pick up the sheet from the sheet feeding tray, a pair of regi-rollers which receive the sheet conveyed by the pick-up roller, and a regi-shutter which is rotatably mounted on at least one of the pair of regi-rollers to oppose the advancing of the sheet, and to rotate to enable the sheet to advance to the pair of regi-rollers when a sheet feeding pressure exceeding a predetermined value is transferred through the sheet, wherein the pick-up roller comprises a pick-up section configured to impart to the sheet a sheet pick-up pressure sufficient to initiate a movement of the sheet towards the pair of regi-rollers and a feed section configured to impart to the sheet the sheet feeding pressure greater than the sheet pick-up pressure of the pick-up section so as to allow the sheet to cause the regi-shutter to rotate.

According to yet another aspect, a pick-up roller is provided to be mounted to rotate about a rotational axis and having outer surface for contacting and sending a sheet of print medium toward the print medium travel path of an image forming apparatus that forms an image on the sheet of print medium, the pick-up roller comprising: a first contact portion at a first location on the outer surface, the first contact portion being configured to contact the sheet of print medium, and to impart thereto a first contact pressure sufficient to initiate an advancement of the sheet of print medium towards the print medium travel path; and a second contact portion at a second location on the outer surface, the second location being downstream to the first location with respect to a rotational direction of the pick-up roller, the second contact portion being configured to contact the sheet of print medium, and to impart thereto a second contact pressure greater than the first contact pressure.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
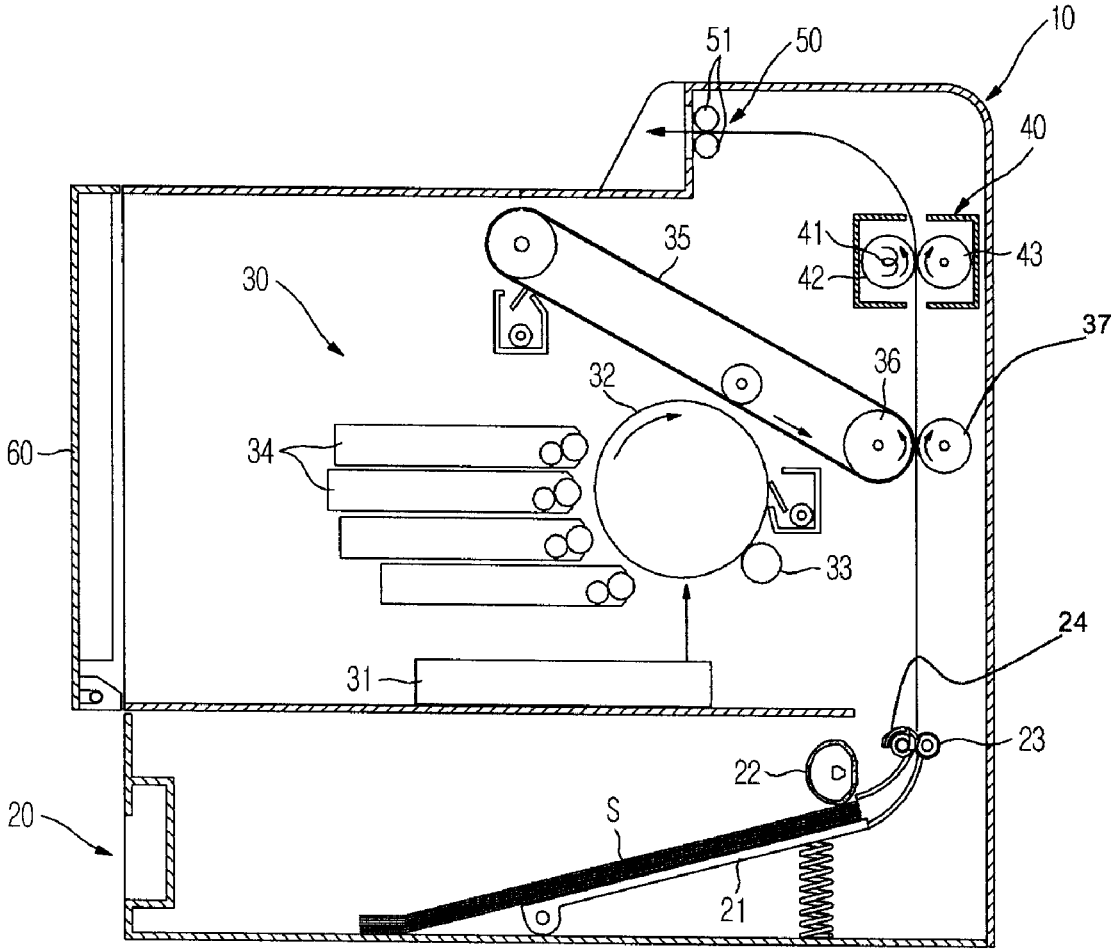
FIG. 1 is a sectional view showing an image forming apparatus according to the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, an image forming apparatus according to the present invention comprises a body 10, a sheet feeding unit 20, an image forming unit 30, a fixing unit 40, and a sheet discharging unit 50. The body 10 makes an external appearance and supports a variety of components included in the image forming apparatus. The sheet feeding unit 20 feeds a sheet S which is a print medium. The image forming unit 30 forms an image on the sheet S. The fixing unit 40 thermally presses the sheet S to fix the image onto the sheet S. The sheet discharging unit 50 discharges the sheet S, which has undergone a printing operation, out of the body 10.

The sheet feeding unit 20 comprises a sheet feeding tray 21, a pick-up roller 22, a pair of regi-rollers 23, and a regi-shutter 24. The sheet feeding tray 21 has a plurality of sheets S stacked thereon. The pick-up roller 22 picks up the sheets S stacked in the sheet feeding tray 21 one by one. The regi-rollers 23 are arranged to oppose each other such that the sheet S is conveyed while passing through the space therebetween. The regi-shutter 24 is rotatably mounted on one of the regi-rollers 23. The regi-shutter 24 rotates only when a predetermined sheet feeding pressure or more is transferred through the front end of the sheet S to allow the sheet S to enter the space between the regi-rollers 23. Although it is not shown in drawings, the regi-shutter 24 is supported by an elastic member to rotate only if the sheet feeding pressure exceeding a predetermined value is transferred through the front end of the sheet S.

The image forming unit 30 comprises an exposure unit 31, a photo-sensitive drum 32, a charging roller 33, four development cartridges 34, an intermediate transfer belt 35, a first transfer roller 36, and a second transfer roller 37. The exposure unit 31 irradiates a laser beam including image information. The photo-sensitive drum 32 has an electrostatic latent image formed on the surface thereof by the exposure unit 31. The charging roller 33 charges the photo-sensitive drum 32. The four development cartridges 34 develop the electrostatic latent image formed on the photo-sensitive drum 32 into a visible image by using yellow, magenta, cyan, and black developers.

The exposure unit 31 comprises a laser diode (not shown), which radiates a laser beam in the exposure unit 31, and a polygon mirror (not shown), which disperses the laser beam generated from the laser diode. Accordingly, the exposure unit 31 delivers the laser beam, which has been dispersed by the polygon mirror, to the photo-sensitive drum 32 positioned above the exposure unit 31 such that the electrostatic latent image is formed on the photo-sensitive drum 32.

The sheet discharging unit 50 comprises a series of sheet discharging rollers 51 sequentially installed such that the sheet S having passed through the fixing unit 40 can be conveyed to the outside of the body 10.

Figure 2:
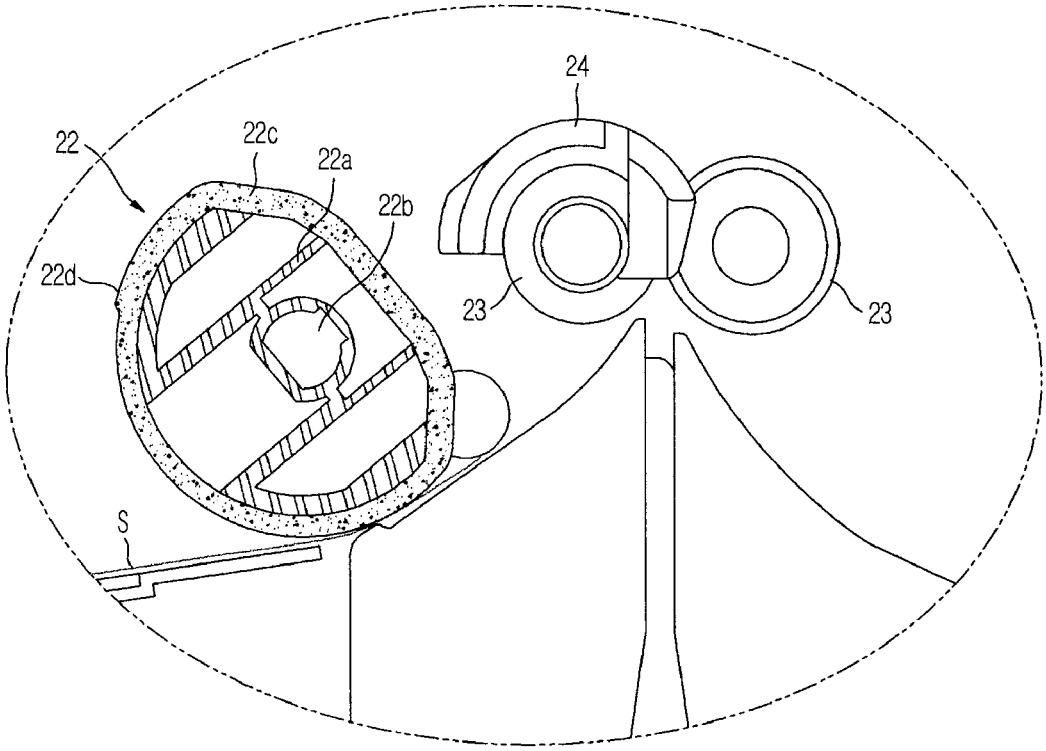
FIGS. 2 and 3 are enlarged views of a pick-up roller employed in an image forming apparatus according to the present invention.

The pick-up roller 22 employed for the image forming apparatus according to the present invention has a sector shape as shown in FIG. 2 such that the sheets S stacked in the sheet feeding tray 21 are selectively picked up according to the rotation angle of the pick-up roller 22. The pick-up roller 22 comprises a frame member 22*a*, which forms the shape of the pick-up roller 22 and comprises a hinge hole 22*b* to receive a torque generated from a driving motor (not shown), and a friction member 22*c*, which covers the outer surface of the frame member 22*a* to make contact with and pick up or convey a sheet S. In this case, the friction member 22*c* comprises an elastically deformable material (e.g., rubber) to deliver a sheet feeding pressure to the sheet S.

In addition, the image forming apparatus according to the present invention can pick up a sheet S from the sheet feeding tray 21 and convey the sheet S through the pick-up roller 22 under a sheet feeding pressure exceeding a predetermined value.

To this end, the pick-up roller 22 comprises a pick-up section used to pick up the sheet S and a feed section providing a sheet feeding pressure greater than that of the pick-up section to convey the sheet S under a predetermined sheet feeding pressure or more. Since sheets S must be sequentially conveyed under a predetermined sheet feeding pressure or more after the sheets S have been picked up, the pick-up section is provided at the front portion of the pick-up roller 22, and the feed section is provided at the rear portion of the pick-up roller 22 along the rotational direction of the pick-up roller 22.

According to the present embodiment, the feed section has a radius greater than that of the pick-up section to generate a sheet feeding pressure greater than that of the pick-up section. For example, a feed unit 22*d* may be provided to protrude from the outer peripheral surface of the friction member 22*c*, thus forming the feed unit 22*d*.

Hereinafter, the operational procedure of the image forming apparatus having the above structure according to the present invention will be described.

Figure 3:
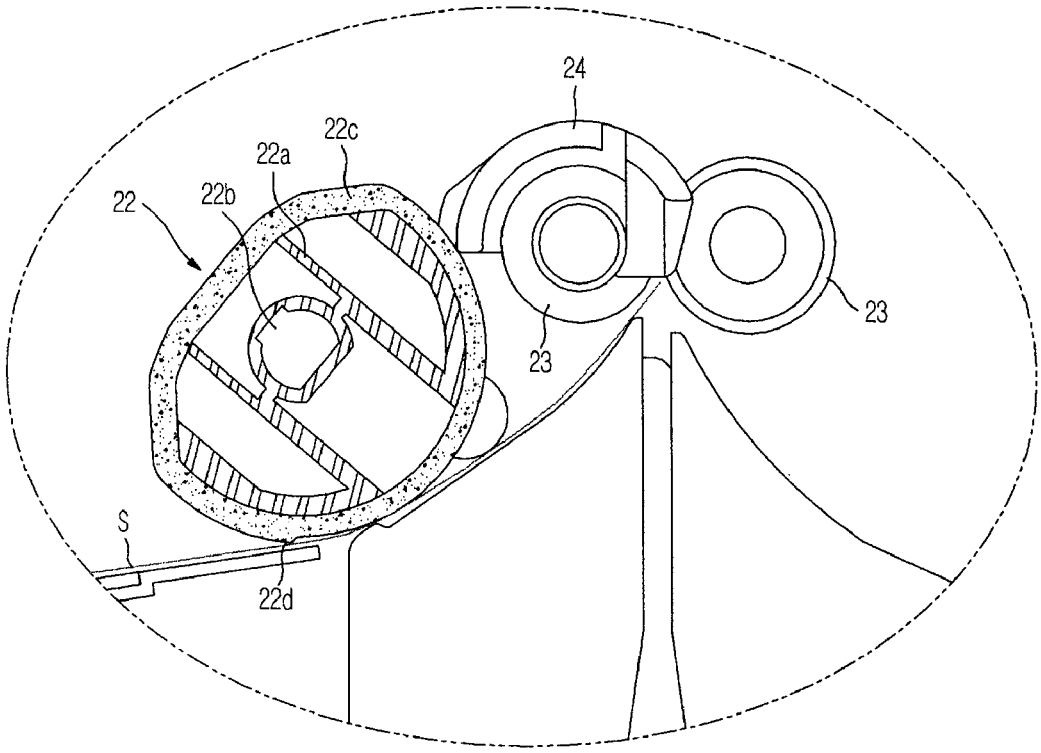

According to the rotation of the pick-up roller 22, the pick-up section positioned at the front portion of the pick-up roller 22 in the rotational direction of the pick-up roller 22 makes contact with and picks up a sheet S stacked in the sheet feeding tray 21 such that the sheet S is conveyed by the pick-up roller 22. When the front end of the sheet S arrives at the regi-shutter 24 as the sheet S is being conveyed, since the sheet feeding pressure of the sheet S, which is being conveyed by the pick-up section, does not reach a sheet feeding pressure enabling the rotation of the regi-shutter 24, a slim phenomenon (e.g., a phenomenon of running idle due to sliding) occurs between the pick-up section and the sheet S. Accordingly, the advancing of the sheet S is stopped temporarily, but the sheet S may continue to be aligned into the proper registration during this time. Subsequently, as shown in FIG. 3, if the feed section positioned at the rear portion of the pick-up roller 22 in the rotational direction of the pick-up roller 22 makes contact with the sheet S, which has been temporarily stopped, to deliver a sheet feeding pressure, which is greater than a sheet feeding pressure from the pick-up section, to the sheet S according to the rotation of the pick-up roller 22, since the sheet feeding pressure delivered by the feed section enables the regi-shutter 24 to rotate, the regi-shutter 24 rotates by the front end of the sheet S so that the sheet S enters the space between the two regi-rollers 23.

In other words, since the pick-up roller 22 employed in the image forming apparatus according to the present invention can generate different sheet feeding pressures, the pick-up roller 22 cannot only pick up the sheet S, but also convey the sheet S under a sheet feeding pressure that equals or exceeds the predetermined minimum pressure necessary to rotate the regi-shutter 24, and to allow the sheet S to pass to the regi-rollers 23.

Figure 4:
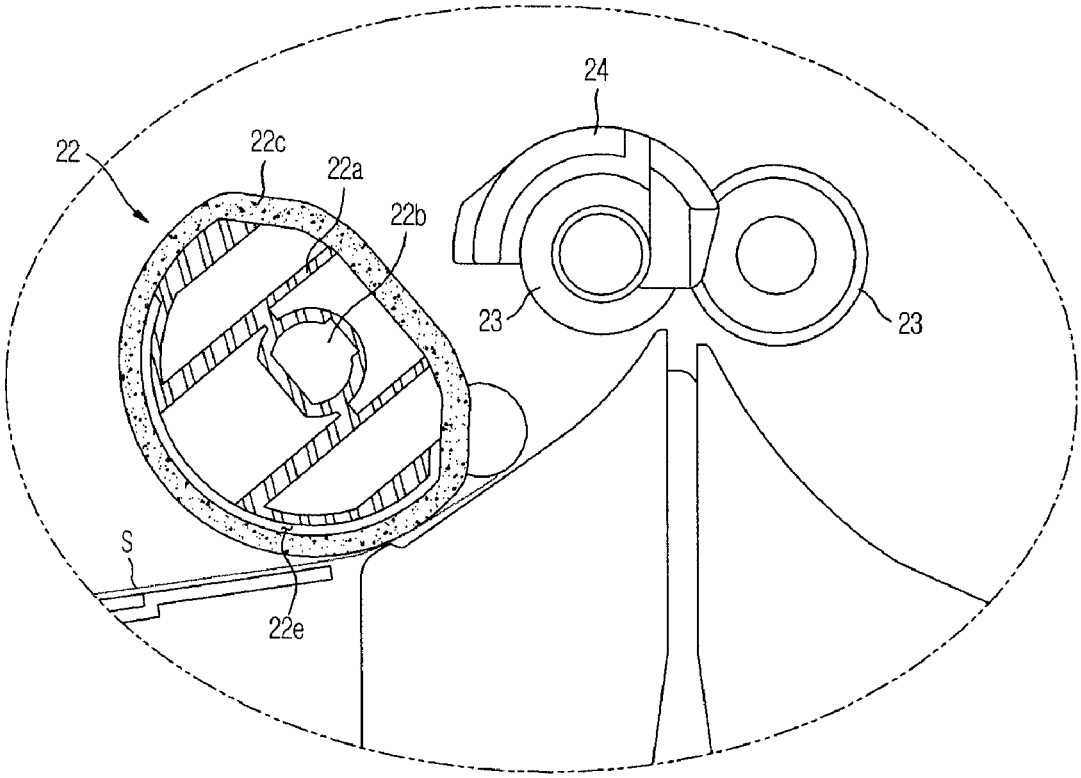
FIG. 4 is an enlarged view showing a pick-up roller employed in an image forming apparatus according to another embodiment of the present invention.

Although the present embodiment has been described in that the feed unit 22*d* protrudes from the outer peripheral surface of the pick-up roller 22 to form the pick-up section having a relatively great radius, the present invention is not limited thereto. For instance, according to another embodiment as shown in FIG. 4, a slot 22*e* can be provided on the outer surface of the frame member 22*a* corresponding to the pick-up section. In this case, the sheet feeding pressure of the pick-up section is reduced due to the slot 22*e*, so that the feed section may generate a sheet feeding pressure greater than that of the pick-up section.

As described above, an image forming apparatus according to the embodiment comprises a pick-up roller having a pick-up section to pick up a sheet and a feed section to generate a sheet feeding pressure greater than that of the pick-up section, so that a component corresponding to a feed roller is not necessary. Accordingly, the structure of the image forming apparatus can become simpler and the height thereof can become lowered. It should be understood that, while a feed roller may not be necessary as a result of the inventive features of the embodiments of pick up roller described above, the mere presence of one or more feed rollers between the pick up roller and the regi-rollers does not depart from the scope of the claims, which is not limited to the absence of any feed rollers.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising: a sheet feeding tray, in which sheets of printing media are stacked, and a pick-up roller to pick up a sheet from the sheets of printing media, wherein the pick-up roller comprises a pick-up section to pick up the sheet and a feed section to deliver to the sheet a first sheet feeding pressure greater than a second sheet feeding pressure delivered by the pick-up section to the sheet, the second feeding pressure being sufficient to initiate a movement of the sheet.

2. The image forming apparatus according to claim 1, wherein the pick-up roller has a sector shape, the pick-up section is provided at a front portion of the pick-up roller along a rotational direction of the pick-up roller, and the feed section is provided at a rear portion of the pick-up roller in the rotational direction of the pick-up roller.

3. The image forming apparatus according to claim 2, wherein the feed section comprises a feed unit protruding from an outer peripheral surface of the pick-up roller such that the feed section has a first radius greater than a second radius of the pick-up section.

4. The image forming apparatus according to claim 3, wherein the pick-up roller comprises a frame member, which comprises a hinge hole to receive a rotary power, and a friction member, which covers an outer surface of the frame member to make contact with the sheet, and wherein the feed unit protrudes from an outer peripheral surface of the friction member.

5. The image forming apparatus according to claim 4, wherein the pick-up roller is located above the sheet feeding tray in which sheets of printing medium are stacked, and wherein the feed unit is spaced apart from the pick-up section by an angle of about 90 degrees about the hinge hole.

6. The image forming apparatus according to claim 2, wherein the pick-up roller comprises a frame member, which comprises a hinge hole to receive a rotary power, and a friction member, which covers an outer surface of the frame member to make contact with the sheet, and wherein the frame member comprises a slot formed on the outer surface of the frame member corresponding to the pick-up section.

7. The image forming apparatus according to claim 1, wherein, when the pickup-roller is rotated to feed the sheet in response to a print command, a distance of a pick-up region in which the pick-up section comes into contact with the sheet is equal to or shorter than a sheet movement distance from an initial contact point between the pick-up section and the sheet to a contact point between the sheet and a plurality of regi-rollers.

8. The image forming apparatus according to claim 1, wherein the pick-up section of the pick-up roller is longer than the feed section of the pick-up roller.

9. The image forming apparatus according to claim 1, further comprising:

a pair of regi-rollers configured to receive the sheet conveyed by the pickup roller, wherein the regi-rollers are located immediately downstream of the pick-up roller along a printing medium travel path, and wherein the sheet is conveyed through the space between the regi-rollers by a sheet feeding pressure delivered by the feed section of the pick-up roller.

10. An image forming apparatus, comprising:

a sheet feeding tray, in which sheets of printing media are stacked:

a pick-up roller configured to pick up a sheet from the sheets of printing media, the pick- up roller comprising a pick-up section to pick up the sheet and a feed section to deliver to the sheet a first sheet feeding pressure greater than a second sheet feeding pressure delivered by the pick-up section to the sheet;

a pair of regi-rollers configured to receive the sheet conveyed by the pick-up roller; and a regi-shutter which is rotatably mounted on at least one of the pair of regi-rollers to allow the sheet to be received by the pair of regi-rollers when a sheet feeding pressure exceeding a predetermined value is transferred through the sheet.

11. A pick-up roller mounted to rotate about a rotational axis and having outer surface for contacting a sheet of print medium, and for sending the sheet of print medium toward a print medium travel path within an image forming apparatus, which forms an image on the sheet of print medium, the pick-up roller comprising:

a first contact portion at a first location on the outer surface, the first contact portion being configured to contact the sheet of print medium, and to impart thereto a first contact pressure sufficient to initiate an advancement of the sheet of print medium toward the print medium travel path; and a second contact portion at a second location on the outer surface, the second location being downstream to the first location with respect to a rotational direction of the pick-up roller, the second contact portion being configured to contact the sheet of print medium, and to impart thereto a second contact pressure greater than the first contact pressure.

12. The pick-up roller according to claim 11, wherein:

the first contact portion has a first radius with respect to the rotational axis of the pick-up roller, the second contact portion has a second radius with respect to the rotational axis, the first radius being smaller than the second radius.

13. The pick-up roller according to claim 12, further comprising:

a roller frame having an outer peripheral surface defining a general shape of the pick-up roller; and a friction member disposed on the roller frame to form the outer surface of the pick-up roller, wherein the second contact portion comprises a protrusion in the outer surface, the protrusion extending radially outward to provide the outer surface at the second location to have the second radius larger than the first radius of the outer surface at the first location.

14. The pick-up roller according to claim 11, further comprising:

a roller frame having an outer peripheral surface defining a general shape of the pick-up roller; and a friction member disposed on the roller frame to form the outer surface of the pick-up roller;

wherein the first contact portion comprises a recess formed in the outer peripheral surface of the roller frame at the first location to reduce the first contact pressure imparted to the sheet of print medium at the first location.

* * * * *